US007318303B1

(12) United States Patent
Kling

(10) Patent No.: US 7,318,303 B1
(45) Date of Patent: Jan. 15, 2008

(54) ARCHITECTURAL SYSTEM INCORPORATING A HYPERSTRUT SPINE

(75) Inventor: Jean-Christophe Jacques Kling, Boulder, CO (US)

(73) Assignee: Aurodyn, Inc., Boulder, CO (US)

( * ) Notice: Subject to any disclaimer, the term of this patent is extended or adjusted under 35 U.S.C. 154(b) by 644 days.

(21) Appl. No.: 10/628,634

(22) Filed: Jul. 28, 2003

(51) Int. Cl.
*E04H 12/00* (2006.01)

(52) U.S. Cl. ..... 52/648.1; 52/651.09

(58) Field of Classification Search ..... 52/652.1, 52/653.1, 654.1, 655.1, 648.1, 651.01, 651.09, 52/651.1; 446/119, 124, 126; 434/227–281, 434/298

See application file for complete search history.

(56) References Cited

U.S. PATENT DOCUMENTS 1,181,013 A * 4/1916 Inglis ..... 14/4
2,855,617 A * 10/1958 Broms et al. ..... 14/13
3,485,005 A * 12/1969 Kutchai ..... 52/651.01
RE35,085 E * 11/1995 Sanderson ..... 52/655.1
2002/0081936 A1* 6/2002 Snelson ..... 446/111

* cited by examiner

*Primary Examiner*—Richard E. Chilcot, Jr.
*Assistant Examiner*—Jessica Laux
(74) *Attorney, Agent, or Firm*—Jonathan E. Olson; Jason P. Webb

(57) ABSTRACT

A node-and-strut structure is made so as to include a "hyperstrut spine" of at least 6 to 10 similar "vertebrae." Each such vertebra includes one "left-hand strut," one "right-hand strut," and one "primary" node rigidly engaging a proximal portion of the left hand strut and of the right hand strut. These vertebrae are arranged so that the primary nodes each intersect a primary axis, so that the left-hand struts are all (nominally) parallel with one another, and so that the right-hand struts are similarly all parallel with one another.

25 Claims, 9 Drawing Sheets

1200

| | 1280 | 1281 | 1282 | 1283 | 1284 | 1285 | 1286 | 1287 | 1288 | 1289 | 1290 | 1291 | 1292 |
|---|---|---|---|---|---|---|---|---|---|---|---|---|---|
| 1205 | 480 | 0 | 0 | 0 | 1 | 490 | 0 | 0 | 0 | 1 | 7 | 1 | 63.4° |
| 1210 | 490 | 0 | 0 | 0 | 1 | 1111 | 1 | 0 | 0 | 0 | 6 | 1 | 148.3° |
| 1215 | 1111 | 1 | 0 | 0 | 0 | 1112 | 1 | 0 | 0 | 0 | 6 | 1 | 36° |
| 1220 | 1131 | 1 | 0 | 0 | 1 | 1132 | 0 | 2 | 0 | 0 | 6 | 1 | 31.7° |
| 1225 | 1132 | 0 | 2 | 0 | 0 | 1133 | 2 | 0 | 0 | 1 | 6 | 1 | 79.2° |
| 1230 | 1133 | 2 | 0 | 0 | 1 | 1134 | 0 | 2 | 0 | 0 | 6 | 1 | 79.2° |
| 1235 | 1134 | 0 | 2 | 0 | 0 | 1135 | 1 | 0 | 0 | 1 | 6 | 1 | 31.7° |
| 1250 | 1331 | 0 | 0 | 2 | 0 | 1332 | 0 | 0 | 2 | 0 | 6 | 0 | 60° |
| 1260 | 1351 | 0 | 1 | 0 | 0 | 1352 | 0 | 1 | 0 | 0 | 9 | 0 | 60° |
| 1270 | 1353 | 0 | 0 | 0 | 1 | 1354 | 0 | 0 | 0 | 1 | 8 | 0 | 70.6° |
| 1275 | 1355 | 0 | 1 | 0 | 0 | 1356 | 0 | 1 | 0 | 0 | 6 | 0 | 60° |

Fig. 12

ARCHITECTURAL SYSTEM INCORPORATING A HYPERSTRUT SPINE

FIELD OF THE INVENTION

This application relates generally to architectural systems and more particularly to node and strut configurations.

BACKGROUND OF THE INVENTION

Despite the many advances in materials over the past several decades, and the continuing interest in alternative building styles such as dome structures, the use of spaceframes in construction continues to be rather limited. Although node and strut systems have been devised and used by some, only very limited types of geometries, generally those based on the cube or pyramid, have achieved widespread use.

One noteworthy exception is the pioneering work of Steve Baer, who on 27 Mar. 1973 was issued U.S. Pat. No. 3,722,153 ("Structural System"). The Baer patent teaches some advantageous systems of nodes and struts. Unfortunately, the teaching in the Baer patent is limited by the small variety of structures included. Another exception is the teaching in U.S. Pat. No. 5,265,395 ("Node Shapes of Prismatic Symmetry for Spaceframe Building System") issued 30 Nov. 1993 to Haresh Lalvani. The Lalvani patent teaches nodes and struts of various geometries, but does not teach any system for constructing rigid, elongated structures incorporating golden geometry.

Those skilled in the art have overlooked substantial benefits that might be achieved in economies of mass production, versatility, high rigidity, low weight and/or ease of assembly in architectural systems incorporating golden geometry. It is to these opportunities that the present invention is directed.

SUMMARY OF THE INVENTION

A node-and-strut structure is made so as to include a "hyperstrut spine" of at least six similar "vertebrae," and more preferably at least seven or eight vertebrae. Applicant has ascertained that such structures permit a maximum structural diversity with a minimum component inventory. In a first apparatus embodying the invention, each such vertebra includes one "left-hand strut," one "right-hand strut," and one "primary" node rigidly engaging a proximal portion of the left hand strut and of the right hand strut. These vertebrae are arranged so that the primary nodes each intersect a primary axis, so that the left-hand struts are all (nominally) parallel with one another, and so that the right-hand struts are similarly all parallel with one another.

Bearing against and rigidly supporting each of the left-hand struts' distal portions is a respective "left-hand node." The left-hand nodes are positioned so that a left-hand axis passes through all of them, the left-hand axis lying in a baseplane with the primary axis. With (a strut axis of) each of the left-hand struts the left-hand axis forms a respective acute angle therebetween about equal to $j\times20.9°+k\times31.7°+m\times36°+n\times37.4°$, where j, k, m, and n are each an integer that is at least 0. (Angular quantities that are "about equal" in this document are rounded conventionally, and thus are within about 0.4° or 0.5°.) Similarly, bearing against and rigidly supporting each of the right-hand struts' distal portions is a respective "right-hand node." The right-hand nodes are positioned so that a right-hand axis passes through all of them, the right-hand axis parallel to (but outside) the baseplane. With (a strut axis of) each of the right-hand struts the right-hand axis forms a respective acute angle therebetween about equal to $p\times20.9°+q\times31.7°+r\times36°+s\times37.4°$, where p, q, r, and s are each an integer $\geqq 0$ also. It will be noted that because these angles are acute, (k+m+n) and (q+r+s) are both at most 2, so this is a restricted class of angles.

In a second embodiment, a method of the present invention includes a step of assembling a set of at least 6 to 10 vertebrae each including one left-hand strut, one right-hand strut, and one primary node assembled as described above. This is done so that a primary axis passes through each of the primary nodes, the primary nodes each including at least 1% metal by weight, the left-hand struts all being nominally mutually parallel, and the right-hand struts all being nominally mutually parallel also. While similarly assembling the left-hand and right-hand nodes according to the first embodiment, additional struts and nodes are assembled into the structure so that each of the nodes couples to at least 3 or 4 struts that are not nominally coplanar. A triangulated structure made by this method is exceedingly strong and lightweight.

In a third embodiment, j=p=0 and the vertebrae have nominally irregular spacing. Also all of these nodes and struts are made primarily of a metal such as aluminum or an iron-containing alloy, preferably more than 50% by weight. All of the nodes preferably have at least a metallic bearing surface that extends inward or outward from the corresponding strut's axis so as to engage a counterpart metallic bearing surface on the node. Metal threading or other bearing structures of this type can provide structural-grade engagement, able to resist a longitudinal compression or tension of about 100 Newtons or more. As summarized in FIG. 12, this document includes examples of this embodiment in which k>0, in which m>0, and/or in which n>0.

In a fourth embodiment, j>0 and the vertebrae have nominally regular spacing. As summarized in FIG. 12, this document includes examples of this embodiment in which k=q=0, in which m=r=0, in which n=s=0, and/or in which n>0. The primary nodes each include at least 1% metal by weight, the struts primarily comprising a glued laminated timber or a hollow metal structure or a carbon fiber structure. For example, each can primarily comprise aluminum or an iron-containing alloy by weight.

In a fifth embodiment, the left-hand and right-hand struts of each of the vertebrae are each nominally aligned along a respective strut axis so as to define two intersecting strut axes that form such an angle therebetween that is nominally equal to (or complementary to) an acute angle of $b\times20.9°+c\times30°+d\times31.7°+e\times35.3°+f\times36°+g\times37.4°$, where b, c, d, e, f, and g are each an integer $\geqq 0$. Note that this acute angle given by the formula can be either the "primary angle" between the vertebra's struts or its complement. Several embodiments are identified below where b=g=0 and either c>0 or d>0. This fifth embodiment further includes a uniform number T of additional strut ends each bearing against a corresponding one of the left-hand nodes, where T is at least 4 or 5.

These and various other features as well as additional advantages which characterize the present invention will be apparent from a reading of the following detailed description and a review of the associated drawings.

BRIEF DESCRIPTION OF THE DRAWINGS

FIG. 12 shows a chart with rows that each correspond with one instance of a hyperstrut spine of the present invention, as depicted in FIGS. 11 & 13.

DETAILED DESCRIPTION

Although the examples below show more than enough detail to allow those skilled in the art to practice the present invention, subject matter regarded as the invention is broader than any single example below. The scope of the present invention is distinctly defined, however, in the claims at the end of this document.

Numerous aspects of spaceframe architecture that are not a part of the present invention (or are well known in the art) are omitted for brevity, avoiding needless distractions from the essence of the present invention. For example, this document does not include much detail about material selection or node design, except where the inventor has observed opportunities for a synergy. Neither does this document address the use of panels, although node-and-strut structures are typically used with "skinning" of some sort.

Definitions and clarifications of certain terms are provided in conjunction with the descriptions below, all consistent with common usage in the art but some described with greater specificity. A "node" is a knob-like structural element that supports one portion of each of several struts. A "strut" is an element used to brace or strengthen a framework by being able to resist a longitudinal compression or tension of about 100 Newtons. A "structural" strut is one that extends between two structural nodes. A "structural" node is an element that supports several struts not all aligned along co-planar axes. These definitions are used because node-and-strut "structures" that do not satisfy these criteria are generally weak or unstable.

First and second angular values are "nominally equal" or "about equal" if they are within about 0.4° or 0.5°. Two lines are "nominally parallel" if mere translation would let them intersect so as to form an angle nominally equal to 0°. A strut is "aligned along" an axis if the axis passes through a strut nominally parallel to the strut's length. A group of struts is "nominally mutually parallel" if the struts in the group are each aligned along a respective one of several parallel axes.

A "complete" strut is one that substantially surrounds its corresponding axis for the entire length between the nodes engaged by the strut. Such a strut will distribute an axial tension or compression on opposing sides of its axis. An arcuate or other "incomplete" strut, by contrast, will bow further away from the axis under axial compression. This greatly reduces the rigidity of the system, or necessitates a needless increase in strut weight. The struts depicted and discussed in this document are all preferably complete and hollow, as solid-strut embodiments of the present invention would be somewhat more massive without a commensurate increase in rigidity. Struts of the embodiments presented in this document can alternatively be constructed of a light fibrous material such as glued laminated timer, fiberglass, carbon fiber, or any of several other commercially available composite-material products.

Figure 1:
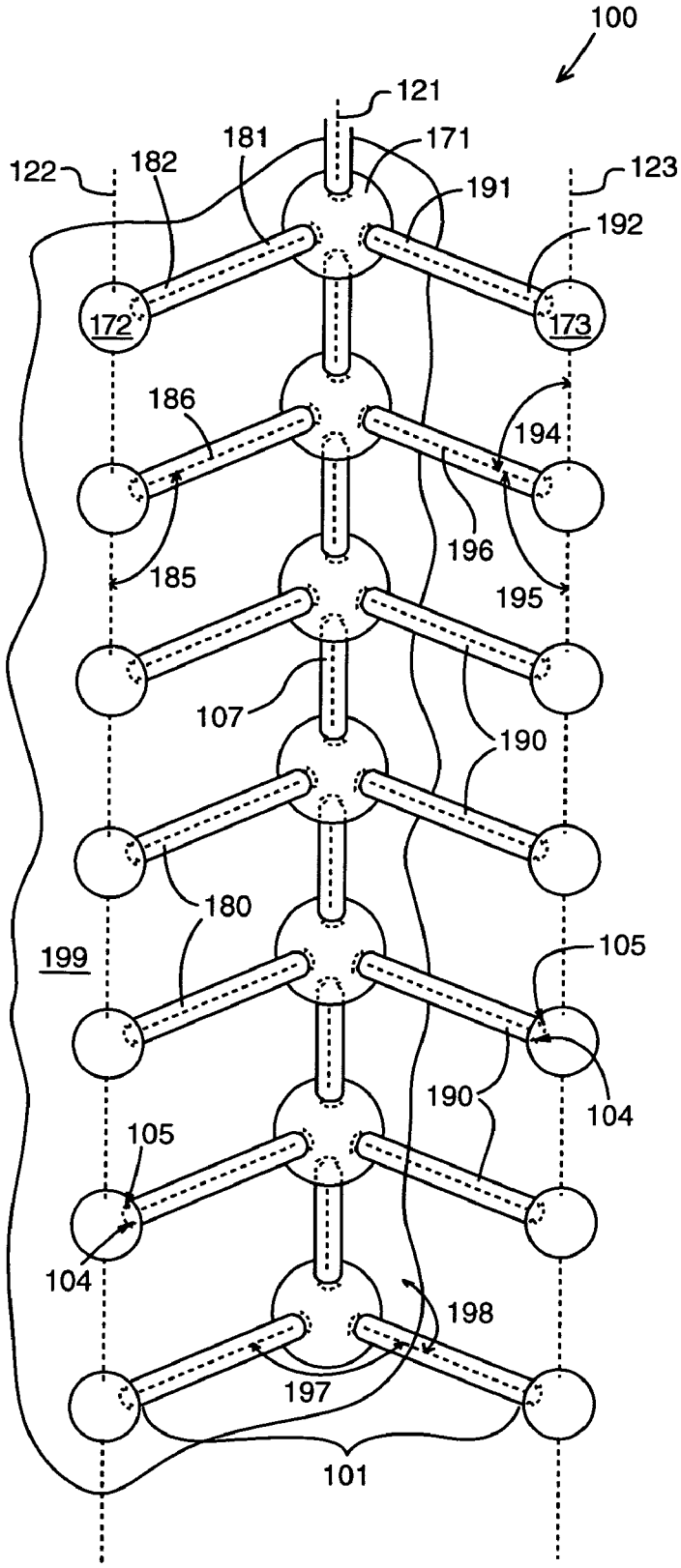
FIG. 1 shows an apparatus of the present invention including a hyperstrut spine with seven similar vertebrae.

Turning now to FIG. 1, there is shown an apparatus of the present invention including a hyperstrut spine 100. Spine 100 includes a set of seven similar vertebrae 101 each including one complete left-hand strut 180, one complete right-hand strut 190, and one primary node 171. Interleaved with the primary nodes along primary axis 121 are several inter-primary struts 107, each of which is coupled to a corresponding pair of the primary nodes 171.

Each left-hand strut 180 and right-hand strut 190 has a proximal end 181,191 and a distal end 182,192. Each primary node 171 rigidly engages the proximal ends of its corresponding left-hand strut and right-hand strut. All of the primary nodes 171 intersect primary axis 121. Each of the left-hand struts 180 is aligned along a respective left-strut axis 186, the left-strut axes 186 all being mutually parallel. Each of the right-hand struts 190 is similarly aligned along a respective right-strut axis 196, the left-strut axes 196 all being mutually parallel.

Several left-hand nodes 172 each intersect a left-hand axis 122 that lies in a baseplane 199 with the primary axis 121. Similarly, several right-hand nodes 173 each intersect a right-hand axis 123 parallel to the baseplane 199 (but not within it). Left-hand axis 122 intersects each of the left-strut axes 186 so as to form an acute angle 185. Acute angle 185 is about equal to $j\times20.9°+k\times31.7°+m\times36°+n\times37.4°$, where j, k, m, and n are all integers $\geqq0$. Right-hand axis 123 intersects each of the right-strut axes 196 so as to form angles 194,195. One of the complementary angles 194,195 is acute, and is about equal to $p\times20.9°+q\times31.7°+r\times36°+s\times37.4°$, where p, q, r, and s are all integers $\geqq0$. Each of the nodes shown has a metallic surface 104 bearing (at least) axially against a respective metallic surface 105 of each respective strut end affixed to the node. These bearing surfaces 104,105 are configured to maintain engagement and resist axial compression and/or tension of at least 100 Newtons along the axis of the strut end.

Angle 197 is seen between (axes of) the left-hand strut 180 and the right-hand strut 190 of each vertebra. In spline 100, either inter-strut angle 197 or its complementary angle 198 is nominally equal to an acute angle of $b\times20.9°+c\times30°+d\times31.7°+e\times35.3°+f\times36°+g\times37.4°$, where b, c, d, e, f, and g are each an integer $\geqq0$. Note that $(c+d+e+f+g)\leqq2$ and $b\leqq4$ for any such acute angle, because any larger sum would correspond to an angle of 90° or larger.

Figure 2:
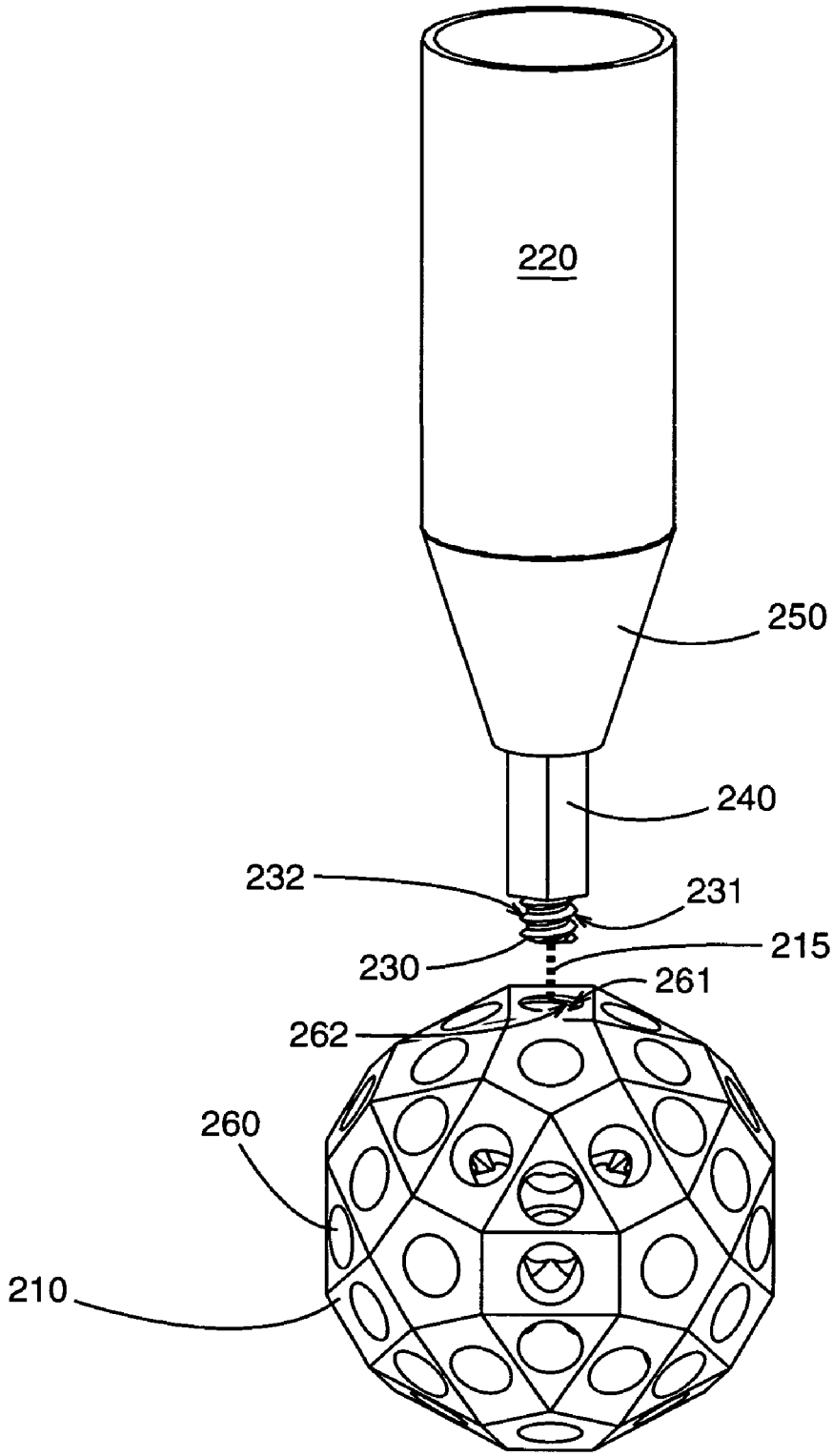
FIG. 2 shows in greater detail how each node can realistically be configured to engage each strut end in the embodiments of this disclosure.

FIG. 2 shows in greater detail how each node 210 can realistically be configured to engage each strut end 220 in the embodiments of this disclosure. The shapes and relative lateral dimensions (i.e. perpendicular to strut axis 215) of nodes and struts in FIG. 2 are realistic for architectural elements of a practical space frame construction material such as an alloy that is at least 5% iron or aluminum by weight. Such shapes and dimensions are merely schematic elsewhere in this document, convenient for showing hyperstrut elements.

In FIG. 2, a protrusion 230 at each hollow strut's end 220 has an axial compression surface 231 and an axial tension surface 232 that each protrude outward from strut axis 215 in a generally radial direction. (In full engagement, it will be noted that a bottom surface of chuck portion 240 comes into forceful compression with a top surface of node 210, so that both of these surfaces will become axial compression surfaces.) Node 210 has 62 threaded bores 260 (one on each surface of the polyhedron as shown) each having an axial compression surface 261 configured to bear axially against surface 231 of strut 220. Each threaded bore also has an axial tension surface 262 configured to bear axially against surface 232 of strut 220. Strut end 220 is constructed so as to cause the threaded protrusion to extend axially from chuck portion 240 when chuck portion 240 rotates clockwise with respect to strut body portion 250. The threaded protrusion 230 similarly retracts axially when chuck portion 240 rotates counterclockwise. Generally similar retractable node/strut coupling designs are described in U.S. Pat. No. 4,193,706, titled "Bolt Connections Between Tubular Rods and Junctions in Three-Dimensional Frameworks." Such couplings are commercially available, as of this writing, from Mero Structures of Menomonee Falls, Wisc., USA (www.mero-.com). In a preferred embodiment of the present invention, each node similarly receives each strut of structural importance, the node's metallic surface bearing axially against those of the strut to form a rigid engagement. It will be understood that FIGS. 3,4,11 & 13 all depict simplified node/strut interfaces so as to focus on hyperstrut macrostructures without undue distraction.

Figure 3:
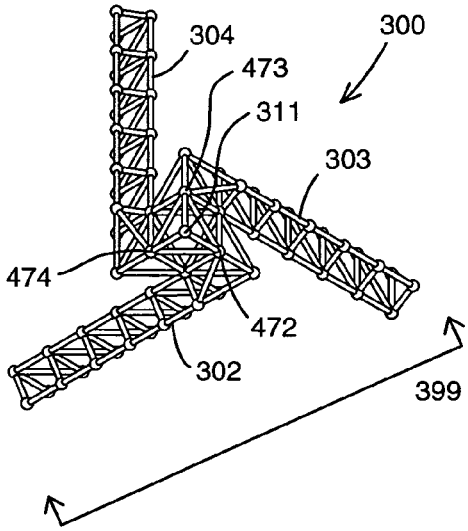
FIG. 3 shows an isometric top view of a very light, rigid tower that is an embodiment of the present invention.

FIG. 3 shows a top view of a very light, rigid tower 300 that is an embodiment of the present invention. It includes three diagonal legs 302,303,304 and a vertical mast having a pinnacle node 311. FIG. 3 is an isometric projection, a somewhat artificial view in which the size of objects is not dependent upon their distance from the viewer. For example, each of the shoulder nodes 472,473,474 of the mast conceals several nodes of the same size directly below it, as shall be apparent in the indirect side view 399 shown in FIG. 4.

Figure 4:
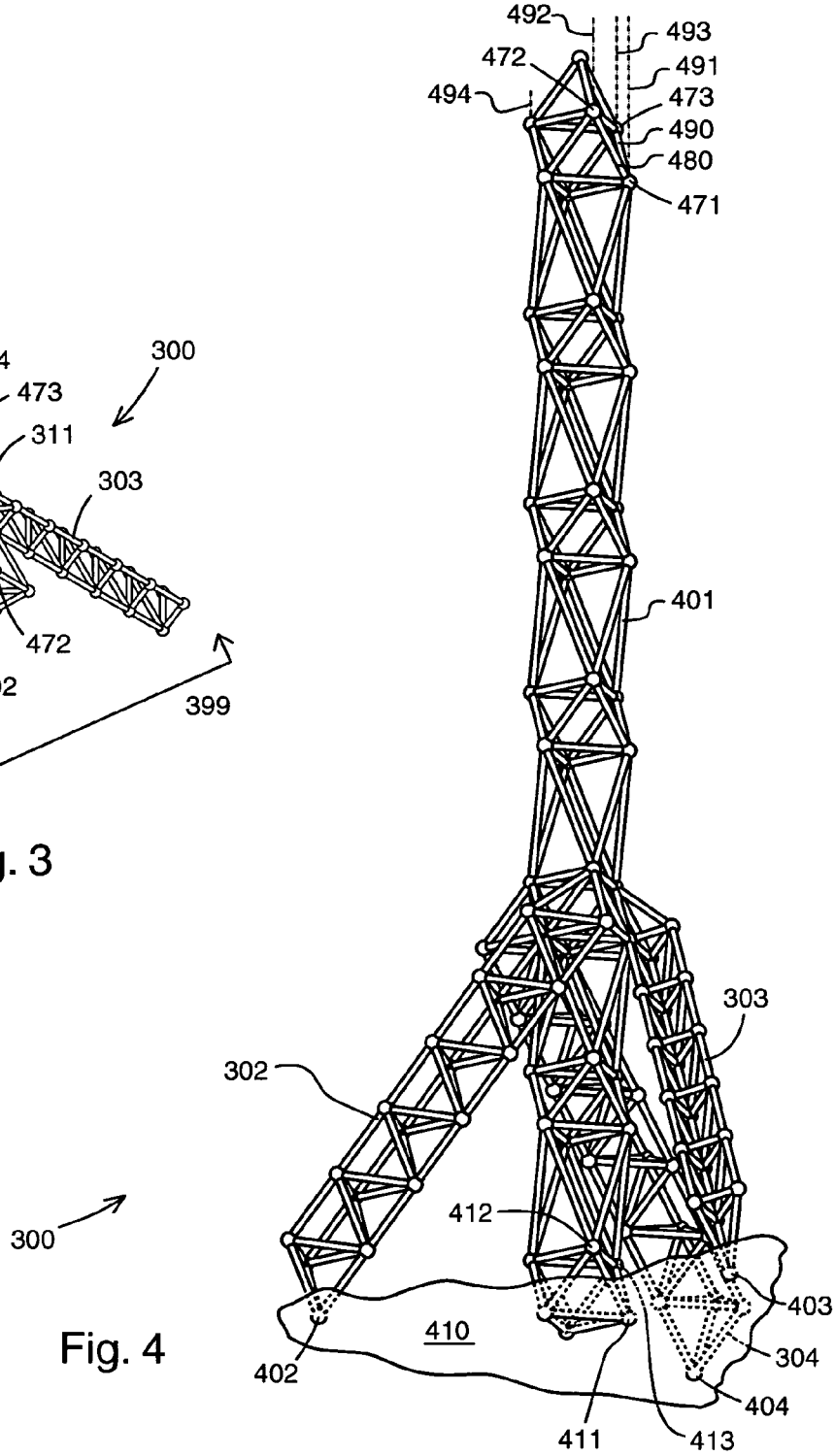
FIG. 4 shows the tower of FIG. 3 in an oblique isometric (indirect side) view from just below a horizontal baseplane.

FIG. 4 shows the tower 300 of FIG. 3 in an (oblique isometric) indirect side view (see view 399 of FIG. 3) from just below horizontal baseplane 410. Diagonal legs 302,303, 304 support vertical mast 401 and extend to baseplane 410. Baseplane 410 passes through node 411 and two others that are part of central mast 401. Baseplane 410 also intersects node 402 of leg 302, node 403 of leg 303, and node 404 of leg 304.

Vertical axis 492 extends through nodes 412 and 472 and 5 nodes in between. Vertical axis 493 extends through nodes 413 and 473 and 5 nodes in between. Vertical axis 491 extends through node 411 and 471 and 5 nodes in between. These axes are helpful for identifying elements of the present invention within the embodiment of tower 300. FIG. 4 shows seven substantially parallel left-hand struts that include strut 480, which is coupled to primary node 471 at its proximal end and to node 472 at its distal end. Also shown are seven substantially parallel right-hand struts that include strut 490, which is coupled to primary node 471 at its proximal end and to node 473 at its distal end. Node 471 is the top one of seven collinear primary nodes aligned along axis 491. Each of these primary nodes is rigidly affixed to a respective one of the left-hand proximal ends and a respective one of the right-hand proximal ends. Each of these 14 proximal ends forms an acute angle with axis 491 that is about equal to $p\times20.9°+q\times31.7°+r\times36°+s\times37.4°$, where p, q, r, and s are all integers. In this example, p=q=r=0 and s=1 for strut 480 (and the 6 similar left-hand struts) and strut 490 (and the 6 similar right-hand struts).

Node 472 is the top one of seven left-hand nodes aligned along axis 492. Node 473 is the top one of seven right-hand nodes aligned along axis 493. Axes 491 and 492 are parallel and lie in a common vertical baseplane, which is parallel to (and not coplanar with) axis 493.

Figure 5:
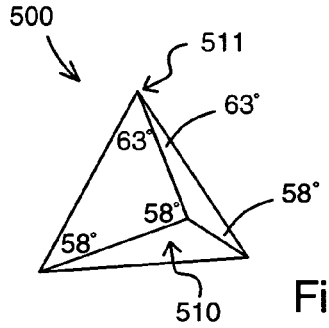
FIG. 5 shows one of the "cells" that is used to articulate the structure tower of FIG. 4 explicitly.

FIG. 5 shows one of the "cells" that is used to articulate the structure of the tower 300 of FIG. 4 explicitly. Other than FIG. 14, each cell in this document is a simple convex polyhedron that has an edge that coincides with most or all of the struts in a part of a structure. Each face of a cell is a polygon having angles between its edges that coincide with angles that are formed between struts of the structure. For example, cell 500 is a tetrahedron having a base 510 that is an equilateral triangle. Cell 500 also has three side faces, each of which is an isosceles triangle with a 63.4° angle at the pinnacle point 511 and two 58.3° angles adjacent to base 510. Four instances of cell 500 occur in tower 300, one at the top of mast 401 and one at the top of each of the legs 302,303,304.

Figure 6:
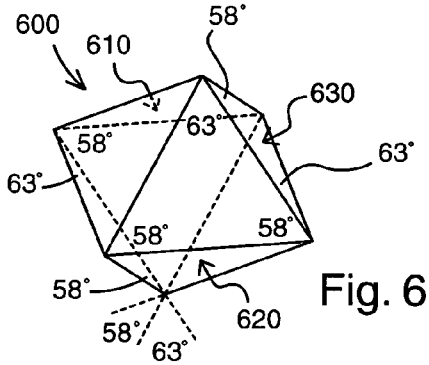
FIG. 6 shows the cell that abuts that of FIG. 5 from below in the tower of FIG. 4.

FIG. 6 shows the cell 600 that abuts cell 500 from below in the tower 300 of FIG. 4. More particularly, in the topmost instance of cells 500 & 600 of tower 300, top 610 coincides with base 510. Top 610 and bottom 620 of cell 600 are both equilateral triangles. The definition of cell 600 is completed by further specifying that the six side faces 630 are all isosceles triangles each having one 63.4° angle and two 58.3° angles. Note that three of the edges of cell 600 are hidden (behind), as indicated by the dashed lines. The bottom angle of the dashed triangle is 63.4°, as can be inferred by its opposite angle labeled at the very bottom of FIG. 6. Instances of cell 600 occur seven times in central mast 401 of tower 300.

Figure 7:
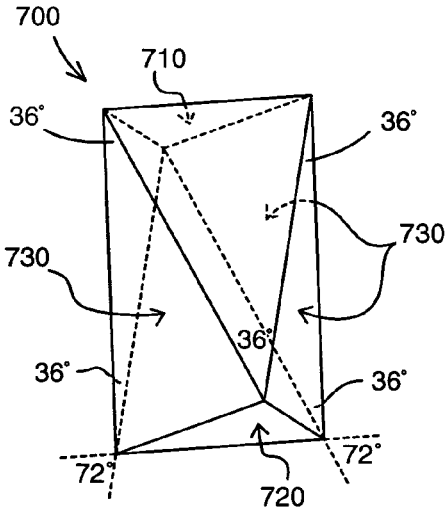
FIG. 7 shows the cell that abuts each instance of the cell of FIG. 5 from below in the tower of FIG. 4.

FIG. 7 shows the cell 700 that alternates between instances of cell 600 in the tower 300 of FIG. 4. More particularly, in the topmost instance of cells 600 & 700 of tower 300, bottom 620 coincides with top 710. Top 710 and bottom 720 of cell 700 are both equilateral triangles. The definition of cell 700 is completed by further specifying that the six side faces 730 are all isosceles triangles each having one 36° angle and two 72° angles. The tall hidden triangle at the rear-most face of cell 700 as seen in FIG. 7 has two 72° angles at its base. All triangles have three interior angles having a sum of 180°, a fact which confirms that the top angle of the rear-most face of cell 700 is 36°. Instances of cell 700 occur six times in central mast 401 of tower 300.

Figure 8:
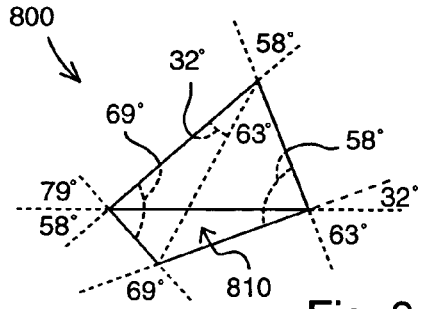
FIG. 8 shows a cell that is an irregular tetrahedron that abuts one side face of the cell of FIG. 5 at the top of each of the three legs of the tower of FIG. 4.

FIG. 8 shows cell 800, an irregular tetrahedron that abuts one side face of cell 500 at the top of each of the three legs 302,303,304 of tower 300. Oriented as shown in FIG. 8, cell 800 has an orientation that corresponds with a component of front leg 302, as can be confirmed by a comparison with FIG. 4. The left rear (hidden) face of FIG. 8 has a top angle of 31.7°, a left middle angle of 69.1°, and a bottom angle of 79.2°. The right rear (hidden) face of FIG. 8 has a top angle of 63.4°, a bottom left angle of 58.3°, and another 58.3° angle on the right side. The top (front) face of FIG. 8 has a top middle angle of 58.3°, a bottom left angle of 58.3°, and a bottom right angle of 63.4°. The bottom (front) face 810 of FIG. 8 has a top left angle of 79.2°, a top right angle of 31.7°, and a bottom middle angle of 69.1°.

Figure 9:
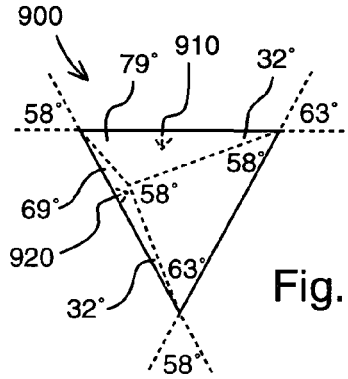
FIG. 9 shows a cell that is an irregular tetrahedron that is actually a mirror image of the cell of FIG. 8.
Figure 10:
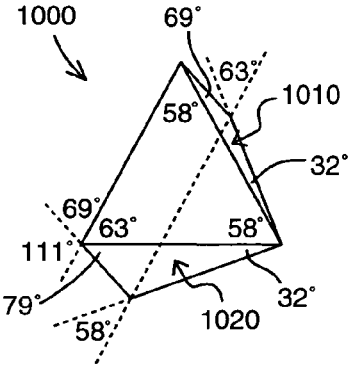
FIG. 10 shows a cell that is a pyramid having a base that is a parallelogram, the last cell that is used in describing the tower of FIG. 4.
Figure 11:
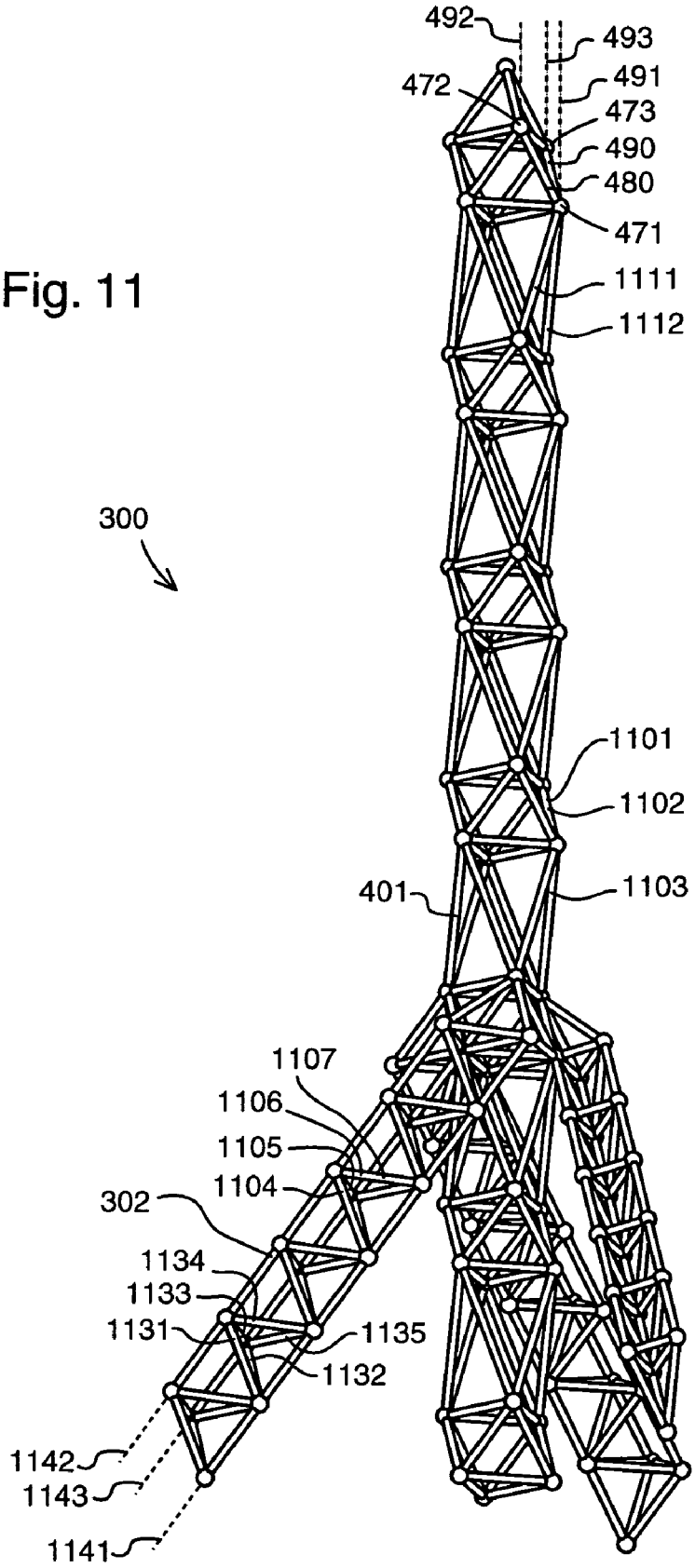
FIG. 11 shows the tower of FIG. 4 again so as to illustrate additional instances of the present invention within it.

Abutting bottom face 810 of FIG. 8 is an instance of top (hidden) face 910 of FIG. 9. (Top face 910 accordingly also has angles of 79.2°, 31.7°, and 69.1° as shown.) FIG. 9 shows cell 900, an irregular tetrahedron that is actually a mirror image of cell 800 across the plane of face 810. Of particular interest is (hidden) face 920, which has angles of 69.1°, 79.2°, and 31.7° as shown. Six instances of cell 900 occur in each of the legs 302,303,304 of tower 300, interleaved with five instances of cell 1000 of FIG. 10.

Cell 1000 is a pyramid having a base that is a parallelogram with interior angles of 69.1° and 110.9°. Adjacent to the two larger interior angles is the 63.4° angle of an isosceles triangle (face) that has two other interior angles of 58.3°, as shown. Each instance of (front) right-side face 1010 of cell 1000 abuts left-side (hidden) face 920 of cell 900. Each instance of bottom-side (hidden) face 1020 of cell 1000 abuts a top-side (hidden) face 910 of cell 900. Tower 300 of FIG. 4 contains a total of 15 instances of cell 1000, five being in each of the legs 302,303,304.

FIG. 11 shows tower 300 again so as to illustrate additional hyperstrut spines of the present invention within it. Recall from the above description of FIG. 4 that struts 480 and 490 extend between nodes on vertical axes 491,492,493, forming angles with axis 491 of about 37.4° (e.g., for j=k=m=p=q=r=0 and n=s=1). Node 471 couples with both struts 480,490, forming an angle of 63.4° between them (see FIG. 6).

Recall that strut 480 is designated as a "left-hand" strut and strut 490 is designated as a "right-hand" strut. Then tower 300 contains exactly seven such primary nodes that each couple to one left-hand proximal strut end and one right-hand proximal strut end, where the left-hand struts are all substantially parallel and the right-hand struts are all substantially parallel. Such a structure defines a spine having seven vertebrae. Let the number of such vertebrae for a given hyperstrut spine be the "count" of the spine. A structure of the present invention preferably has a count of at least 6, and more preferably has a count of at least 7 or 8.

Another optional property of some hyperstrut structures is "regularity." As used herein, a "regular" hyperstrut structure is one in which the vertebrae as described above are distributed with nominally uniform spacing. As summarized below in FIG. 12, FIG. 13 contains some "regular" structures and some "irregular" structures. It is evident from an examination of FIGS. 1 & 11, however, that all of the hyperstrut spines identified in those figures are "regular." The concept of a "count" and a "regularity" of a given hyperstrut spine will be clarified further by the examples that follow.

Referring again to FIG. 11, note that struts 1111 and 1112 also extend between nodes on vertical axes 491,492,493, forming angles with axis 491 of about 20.9° (e.g., j=p=1 and k=m=n=q=r=s=0). Thus it can be seen that mast 401 contains exactly six vertebrae of which one includes left-hand strut 1111 and right-hand strut 1112. Spines 1101,1102,1103, 1104,1105,1106, and 1107 are each an embodiment of the present invention, each having a structure concisely described with reference to FIG. 12.

FIG. 12 shows a chart 1200 with rows 1205 through 1275 that each correspond with one instance of a hyperstrut spine of the present invention. Each of the 11 cells in column 1280 contains a reference number of one of the left-hand struts, and the same-row's cell in column 1285 contains a reference number of a corresponding right-hand strut (i.e. of the same hyperstrut spine). Chart 1200 and this text include enough description to enable one of ordinary skill to identify all of the vertebrae relating to each spine described, within FIG. 11 or FIG. 13.

Recalling that each hyperstrut spine has a left-hand acute angle about equal to j×20.9°+k×31.7°+m×36°+n×37.4°, the integers j, k, m, and n are given respectively in columns 1281, 1282, 1283, and 1284. The integers for the right-hand acute angles are similarly defined by the integers p, q, r, and s that are likewise given respectively in columns 1286, 1287, 1288, and 1289. Column 1290 indicates the count of each hyperstrut spine embodiment, and column 1291 indicates its regularity (with zero indicating nominal irregularity). Finally, column 1292 indicates the inter-strut angle between the two struts of each vertebra.

Row 1205 describes the structure of spin 1101, indicating seven regularly-spaced vertebrae of which one includes struts 480 and 490. (See mast 401 of FIG. 11.) Row 1205 further indicates that strut 480 is a left-hand strut that forms an acute angle of about 37° with its left-hand axis (i.e. axis 492). Row 1205 further indicates that strut 490 is a right-hand strut that forms an acute angle of about 37° with its right-hand axis. The last cell in row 1205 indicates a primary angle (like angle 197 of FIG. 1) nominally equal to an acute angle of 63.4° (d=2).

Row 1210 describes the structure of spine 1102, indicating six regularly-spaced vertebrae of which one includes struts 490 and 1111. (See FIG. 11.) Row 1210 further indicates that strut 490 is a left-hand strut that forms an acute angle of about 37° with its left-hand axis (i.e. axis 493). Row 1210 further indicates that strut 1111 is a right-hand strut that forms an acute angle of about 21° with its right-hand axis. The last cell in row 1210 indicates a primary angle nominally complementary to an acute angle of 31.7° (d=1).

Row 1215 describes the structure of spine 1103, indicating six regularly-spaced vertebrae of which one includes struts 1111 and 1112. (See FIG. 11.) Row 1215 further indicates that strut 1111 is a left-hand strut that forms an acute angle of about 21° with its left-hand axis (i.e. axis 493). Row 1210 further indicates that strut 1112 is a right-hand strut that forms an acute angle of about 21° with its right-hand axis. Note that the central mast 401 can be extended to a count of more than six by inserting additional instances of cells 600 and 700 just below the topmost instance of cell 500. The last cell in row 1215 indicates a primary angle nominally equal to an acute angle of 36° (f=1).

Row 1220 describes the structure of spine 1104, indicating six regularly-spaced vertebrae of which one includes struts 1131 and 1132. (See leg 302 of FIG. 11.) Row 1220 further indicates that strut 1131 is a left-hand strut that forms an acute angle of about j×20.9°+n×37.4°=58.3° with its left-hand axis (i.e. axis 1142). Row 1220 further indicates that strut 1132 is a right-hand strut that forms an acute angle of about q×31.7°=63.4° with its right-hand axis. The last cell in row 1220 indicates a primary angle nominally equal to an acute angle of 31.7° (d=1).

Row 1225 describes the structure of spine 1105, indicating six regularly-spaced vertebrae of which one includes struts 1132 and 1133. (See FIG. 11.) Row 1225 further indicates that strut 1132 is a left-hand strut that forms an acute angle of about 63° with its left-hand axis (i.e. axis 1141). Row 1225 further indicates that strut 1133 is a right-hand strut that forms an acute angle of about p×20.9°+ s×37.4°=79° with its right-hand axis. The last cell in row 1225 indicates a primary angle nominally equal to an acute angle of 79.2° (b=2,g=1).

Row 1230 describes the structure of spine 1106, indicating six regularly-spaced vertebrae of which one includes struts 1133 and 1134. (See FIG. 11.) Row 1230 further indicates that strut 1133 is a left-hand strut that forms an acute angle of about 79° with its left-hand axis (i.e. axis 1143). Row 1230 further indicates that strut 1134 is a right-hand strut that forms an acute angle of about q×31.7°=63° with its right-hand axis. The last cell in row 1230 indicates a primary angle nominally equal to an acute angle of 79.2° (b=2,q=1).

Row 1235 describes the structure of spine 1107, indicating six regularly-spaced vertebrae of which one includes struts 1134 and 1135. (See FIG. 11.) Row 1235 further indicates that strut 1134 is a left-hand strut that forms an acute angle of about k×31.7°=63.4° with its left-hand axis (i.e. axis 1142). Row 1235 further indicates that strut 1135 is a right-hand strut that forms an acute angle of about 58.3° with its right-hand axis. The last cell in row 1235 indicates a primary angle nominally equal to an acute angle of 31.7° (d=1).

Figure 13:
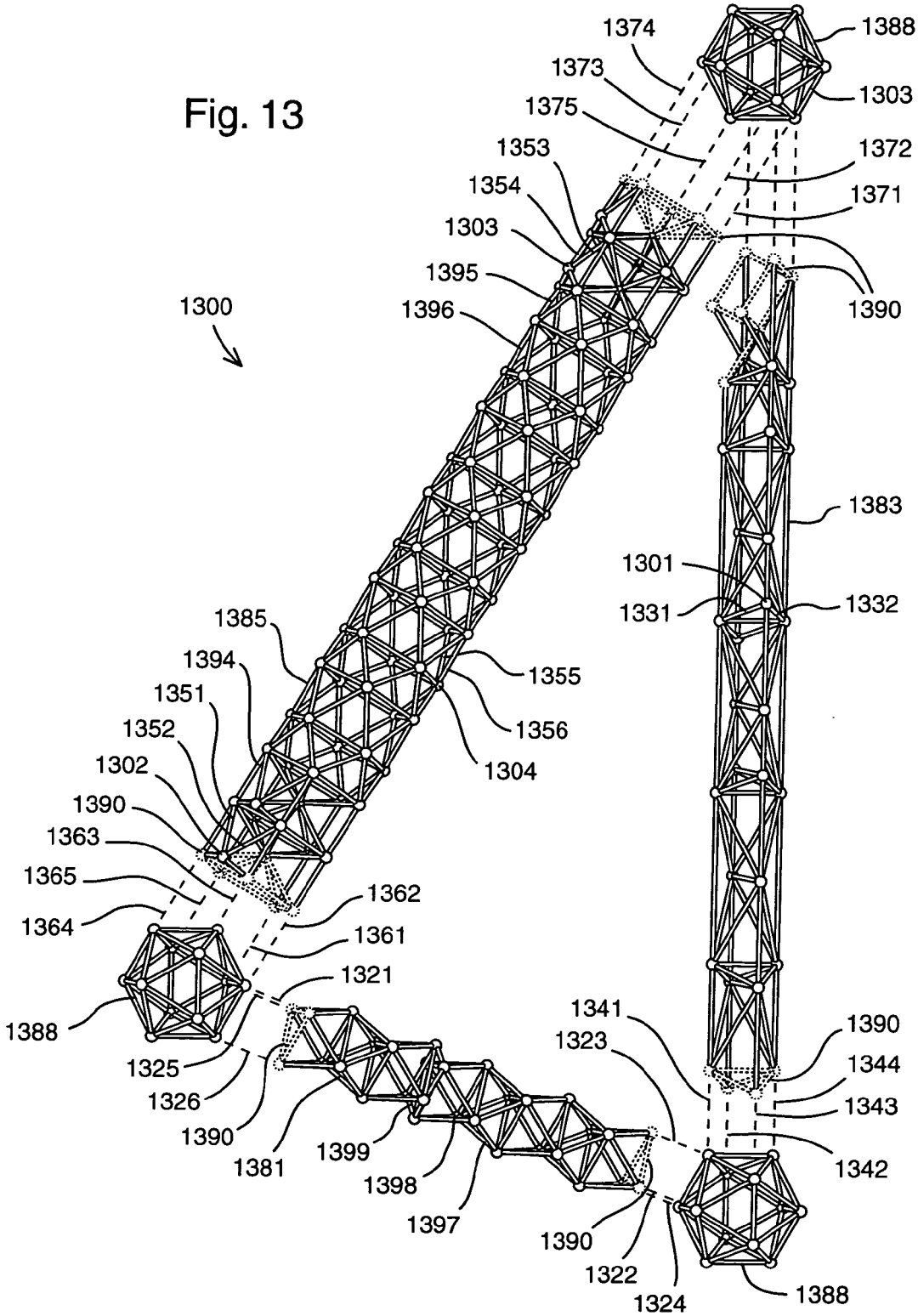
FIG. 13 shows a "hyper-triangle" of the present invention composed of three hyperstruts (legs) joined at three icosahedra (vertexes).

Referring now to FIG. 13, there is shown a triangular frame 1300 of hyperstruts in a partially exploded view. Frame 1300 includes multiple spines 1301,1302,1303,1304 of the present invention. Spine 1301 includes struts 1331 and 1332. Referring now to FIGS. 12 & 13, row 1250 indicates that spine 1301 includes six irregularly-spaced vertebrae. Row 1250 further indicates that strut 1331 is a left-hand strut that forms an acute angle of about 72° with its left-hand axis (i.e. axis 1341). Row 1250 further indicates that strut 1332 is a right-hand strut that also forms an acute angle of about 72° with its right-hand axis (i.e. axis 1344). The last cell in row 1250 indicates a primary angle (like angle 197 of FIG. 1) nominally equal to an acute angle of 60° (c=2).

Row 1260 describes the structure of spine 1302, indicating nine irregularly-spaced vertebrae of which one includes struts 1351 and 1352. (See FIG. 13.) Row 1260 further indicates that strut 1351 is a left-hand strut that forms an acute angle of about 31.7° with its left-hand axis (i.e. axis 1364). Row 1260 further indicates that strut 1352 is a right-hand strut that forms an acute angle of about 31.7° with its right-hand axis (i.e. axis 1363). Two of the nine irregularly-spaced vertebrae form part of the regular icosahedra 1388 affixed to the ends of leg 1385. The last cell in row 1260 indicates a primary angle nominally equal to an acute angle of 60° (c=2).

Row 1270 describes the structure of spine 1303, indicating eight irregularly-spaced vertebrae of which one includes struts 1353 and 1354. (See FIG. 13.) Row 1270 further indicates that strut 1353 is a left-hand strut that forms an acute angle of about 37.4° with its left-hand axis (i.e. axis 1373). Row 1270 further indicates that strut 1354 is a right-hand strut that forms an acute angle of about 37.4° with its right-hand axis (i.e. axis 1374). The last cell in row 1270 indicates a primary angle nominally equal to an acute angle of 70.6° (e=2).

Row 1275 describes the structure of spine 1304, indicating 6 irregularly-spaced vertebrae of which one includes struts 1355 and 1356 (in this example including the bottom icosahedron 1388 but excluding the top icosahedron 1388). (See FIG. 13.) Row 1275 further indicates that strut 1355 is a left-hand strut that forms an acute angle of about 31.7° with its left-hand axis (i.e. axis 1361). Row 1275 further indicates that strut 1356 is a right-hand strut that forms an acute angle of about 31.7° with its right-hand axis (i.e. axis 1362). The last cell in row 1275 indicates a primary angle nominally equal to an angle of 60° (c=2).

Recall from the "summary" section above that the "fifth" embodiment described there recites an angle between struts of each vertebra that is nominally (equal to or) complementary to an acute angle of b×20.9°+c×30°+d×31.7°+e×35.3°+f×36°+g×37.4°, where b, c, d, e, f, and g are each an integer ≧0. Row 1275 describes such an embodiment, one in which b=d=e=f=g=0 and c=2. Recall also that this "fifth" embodiment further requires that a uniform (total) number T of additional strut ends each bear against a corresponding one of the left-hand nodes, where T is at least 4 or 5. An examination of FIGS. 12 & 13 will reveal that the embodiment of row 1275 satisfies this recitation also, with T=5 (still excluding the top icosahedron 1388).

Each of these 11 rows 1205 through 1275 describes a respective embodiment of the present invention. All 11 of these embodiments incorporate all of the features mentioned above relative to FIG. 1 to the extent consistent with FIGS. 11-13. In the embodiment of row 1205, for example, strut 480 of FIG. 11 incorporates surfaces 104,105 and all of the other features described above with respect to left-hand struts 180 of FIG. 1. The angles and structure shown in FIG. 11 take precedence, however, and so it should be understood that the hyperstrut spine 1101 of this embodiment does not incorporate any inter-primary struts 107. A review of FIGS. 11-13 will reveal that the embodiments of rows 1220,1225,1230,1235,1250 each incorporate several basic inter-primary struts 107 each coupling to two primary nodes, but that the embodiments of rows 1205,1210,1215,1260,1270,1275 do not.

Referring again to FIG. 13, three nominally regular icosahedra 1388 are used for joining three legs 1381,1383,1385. All of the nodes of leg 1381 are aligned on a corresponding one of six axes 1321,1322,1323,1324,1325,1326 as shown. "Ghost" elements 1390 (nodes and struts) are each drawn in dashed lines at each end of leg 1381 to show how a corresponding element in both icosahedra 1388 couples into the actual elements of the leg. Legs 1383 and 1385 also include ghost elements 1390 at each end, duplicating actual elements drawn elsewhere. All of the actual nodes of leg 1383 are aligned along a respective one of four axes 1341,1342,1343,1344. All of the nodes of leg 1385 are aligned along a central axis (not shown) or a respective one of ten external axes 1361,1362,1363,1364,1365,1371,1372,1373,1374,1375.

To further clarify the structure of frame 1300, substructures 1394,1395,1396,1397,1398,1399 are shown that correspond with cells in FIGS. 14-19. Leg 1383 is not broken down into cells, however. This is because almost all of the triangles formed by actual struts in leg 1383 are nominally 36°/72°/72°, 60°/60°/60°, or 108°/36°/36°. It is easy to distinguish these shapes visually in FIG. 13.

It has been mentioned that one advantage that can be gained by using geometries of the present invention is economy of scale. In FIG. 13, this is manifested in that the entirety of "hyper-triangle" frame 1300 can be assembled and fully triangulated as shown using only seven different (nominal) strut lengths, for use with a uniform type of node. Tower 300 of FIG. 4, in fact, can be assembled and fully triangulated as shown using only four distinct nominal strut lengths. Leg 1383 can be assembled and fully triangulated as shown with only three lengths, even including icosahedra 1388 affixed to each end. Leg 1385 can be assembled and fully triangulated as shown with only five lengths, even including icosahedra 1388 affixed to each end. More broadly, structures of the present invention preferably have a core (consisting of the claimed elements plus basic elements for full triangulation) such that all of their struts each have a length that is nominally included in a predefined set consisting of at most 3 to 8 lengths, and more typically at most 5 to 7 lengths.

Figure 14:
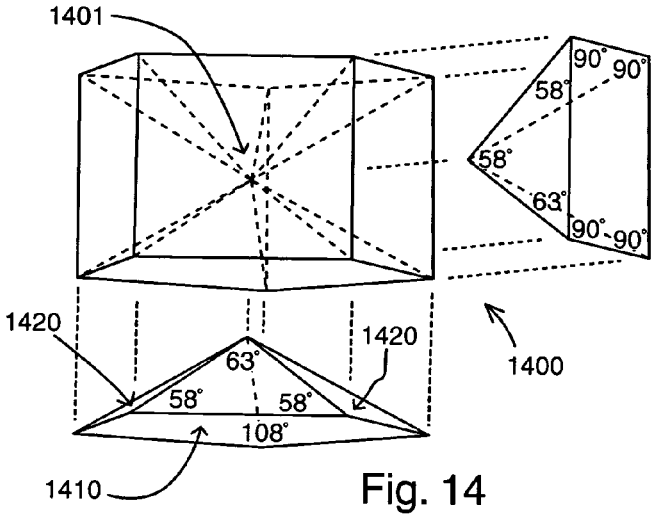
FIG. 14 shows a complex cell nominally corresponding to a sub-structure that occurs several times in the embodiment of FIG. 13.

Referring now to FIG. 14, there is shown a complex cell 1400 nominally corresponding to sub-structure 1394 of FIG. 13. Four instances of cell 1400 occur in leg 1385, two of them upside-down. Cell 1400 includes a top and bottom 1410 that are each a regular pentagon. Cell 1400 also includes 5 rectangular sides. An internal nexus point 1401 is slightly below the center point of cell 1400, defining a pentagonal pyramid (inverted as shown) with 5 sides that are each an equilateral triangle. Nexus point 1401 also defines a pentagonal pyramid (upright as shown) with 5 sides 1420 that are each a 63.4°/58.3°/58.3° (isosceles) triangle. Nexus point 1401 also defines 5 irregular rectangular pyramids, one of which is shown, each having three isosceles triangles and one equilateral triangle.

Referring again to FIG. 13, it has been mentioned that leg 1385 includes four nodes (at nexus points 1401) along a central axis of leg 1385, and six such nodes if the entire icosahedra 1388 affixed to each end are included. FIG. 14 clarifies how these nodes and the struts affixed to them are positioned. Such internally-positioned nodes are advantageous for lending stability to a hyperstrut. Leg 1385 is, in fact, a preferred embodiment of the present invention in which the (claimed) nodes and several additional nodes are all positioned exteriorly so as to form an oblong shape (i.e. leg 1385) substantially resembling a tube having an elliptical cross section, further comprising several other, interiorly-positioned nodes that lend rigidity. A set of nodes form an "oblong shape substantially resembling a tube," as described herein, if a simple tube can be defined so that its exterior surface will intersect with substantially all nodes in the set. Such is the case with all of the legs 302,303,304,1381,1383, 1385 mentioned above, and also with mast 401.

Figure 15:
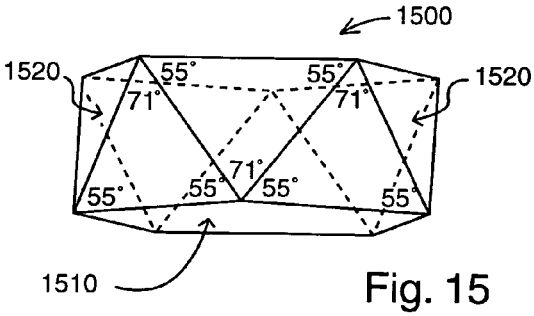

Referring now to FIG. 15, there is shown another cell 1500 having a top and bottom 1510 that are regular pentagons. Cell 1500 occurs six times in leg 1385, one of them nominally corresponding to sub-structure 1395. Cell 1500 has ten sides 1520 that are each a 70.5°/54.7°/54.7° triangle (isosceles) as shown.

Figure 16:
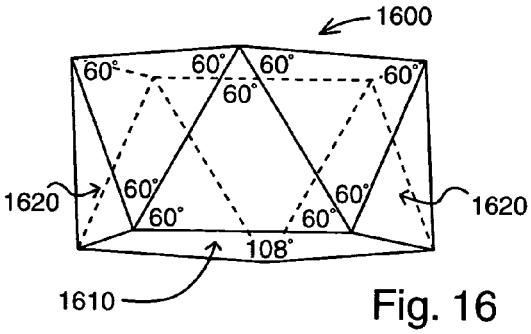

FIG. 16 shows yet another cell 1600 having a top and bottom 1610 that are regular pentagons. Cell 1600 occurs five times in leg 1385 (excluding the icosahedra 1388), one of them nominally corresponding to sub-structure 1396. Cell 1600 has ten sides 1620, each an equilateral triangle.

Figure 17:
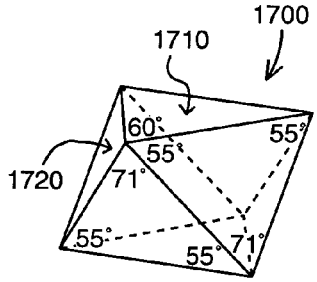
FIGS. 15-19 each shows another cell to further clarify the structure of FIG. 13.

FIG. 17 shows a cell 1700 that occurs three times in leg 1381, one of them nominally corresponding to sub-structure 1397. Cell 1700 has a bottom and top 1710 that are each an equilateral triangle. Cell 1700 also has six sides 1720 that are each a 70.5°/54.7°/54.7° triangle (isosceles) as shown.

Figure 18:
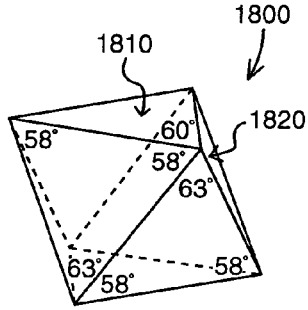

FIG. 18 shows a cell 1800 that occurs five times in leg 1381, one of them nominally corresponding to sub-structure 1398. Cell 1800 has a bottom and top 1810 that are each an equilateral triangle. Cell 1800 also has six sides 1820 that are each a 63.4°/58.3°/58.3° triangle (isosceles) as shown. Cell 1800 is the same as cell 600 of FIG. 6, oriented differently.

Figure 19:
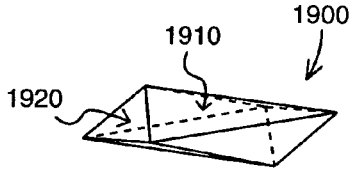

FIG. 19 shows a cell 1900 that occurs only once in leg 1381, nominally corresponding to sub-structure 1399. Cell 1900 has a bottom and top 1910 that are each an equilateral triangle. Cell 1900 also has six sides 1920 that are each a 116.6°/31.7°/31.7° triangle (isosceles) as shown.

Referring again to FIG. 13, it will be noted that four of the irregular pyramids with rectangular bases are not illustrated with any of the cells of FIGS. 14-19. One of these cells would be adjacent to the axes of struts 1353 & 1354, and its twin is just above it. These cells have four triangular sides, one equilateral, one 138.2°/20.9°/20.9°, and two 31.7°/69.1°/79.2°. Another of these cells would be adjacent to the axes of struts 1351,1352, and its twin just above it. These cells have four triangular sides, one 70.5°/54.7°/54.7°, one 116.6°/31.7°/31.7°, and two 37.4°/63.4°/79.2°.

Figure 20:
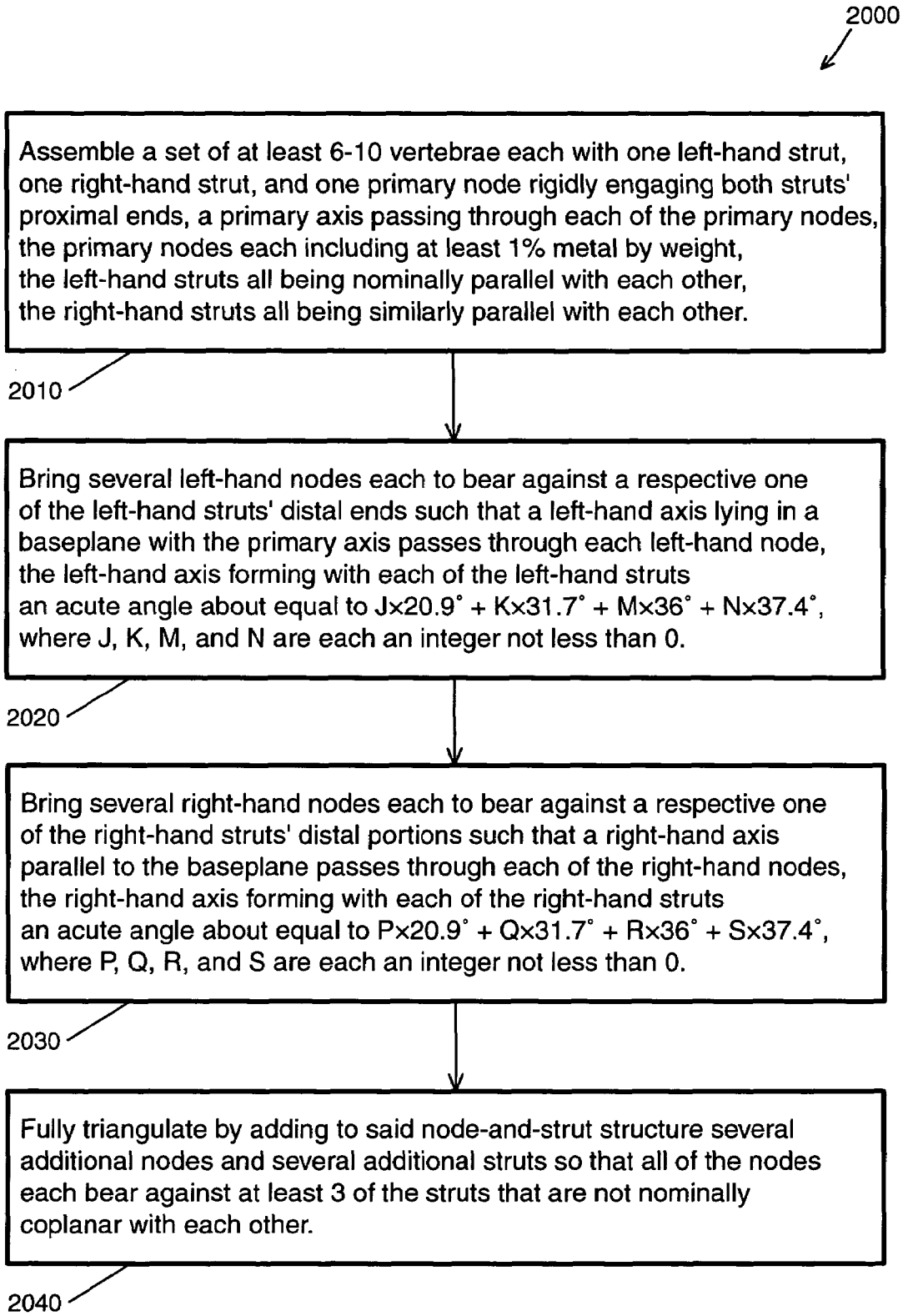
FIG. 20 shows a flowchart of a method of the present invention.

FIG. 20 shows a flowchart 2000 of the present invention including steps 2010 through 2040. In step 2010, at least 6 to 10 primary nodes are constructed so that each includes at least 1% metal by weight, the metal preferably being on or near bearing surfaces (like surface 104 of FIG. 1). Also during step 2010 a set of at least 6 to 10 similar vertebrae are assembled, each vertebra including one left-hand strut having a proximal portion and a distal portion, one right-hand strut having a proximal portion and a distal portion, and one primary node rigidly engaging the left-hand strut's proximal portion and the right-hand strut's proximal portion. Step 2010 is performed so that the primary nodes are each made to intersect a primary axis, so that the left-hand struts are all (nominally) parallel with each other, and so that the right-hand struts are all (nominally) parallel with each other.

In step 2020, several left-hand nodes are each brought to bear against a respective one of the (left-hand struts') distal portions and each to intersect a left-hand axis that lies in a baseplane with the primary axis. This is performed so that this left-hand axis intersects each of the left-strut axes so as to form an acute angle therebetween about equal to $J\times20.9°+K\times31.7°+M\times36°+N\times37.4°$, where J, K, M, and N are each an integer $\geqq 0$.

Similarly in step 2030, several right-hand nodes are each brought to bear against a respective one of the (right-hand struts') distal portions and each to intersect a right-hand axis that lies in a baseplane with the primary axis. This is performed so that this right-hand axis intersects each of the right-strut axes so as to form an acute angle therebetween about equal to $P\times20.9°+Q\times31.7°+R\times36°+S\times37.4°$, where P, Q, R, and S are each an integer $\geqq 0$.

In step 2040, these nodes and struts are assembled into a triangulated structure using several additional struts so that each of the nodes couples to at least 3 struts that are not nominally coplanar. This is performed, typically using additional nodes also, so as to generate hypertriangle structures such as the hyperstrut legs 302,1381,1383,1385 described above with reference to FIGS. 3-19.

All of the structures and methods described above will be understood to those skilled in the art, and would enable the practice of the present invention without undue experimentation. It is to be understood that even though numerous characteristics and advantages of various embodiments of the present invention have been set forth in the foregoing description, together with details of the structure and function of various embodiments of the invention, this disclosure is illustrative only. Changes may be made in the details, especially in matters of structure and arrangement of parts within the principles of the present invention to the full extent indicated by the broad general meaning of the terms in which the appended claims are expressed.

What is claimed is:

1. A node-and-strut structure comprising:

a set of at least six vertebrae each including one left-hand strut having a proximal portion and a distal portion, one right-hand strut having a proximal portion and a distal portion, and one primary node rigidly engaging the left-hand strut's proximal portion and the right-hand strut's proximal portion, a primary axis passing through each of the primary nodes, the primary nodes each including at least 1% metal by weight, the left-hand struts all being nominally mutually parallel, the right-hand struts all being nominally mutually parallel also;

several left-hand nodes each bearing against a respective one of said left-hand struts' distal portions such that a left-hand axis lying in a baseplane with the primary axis passes through each of the left-hand nodes, the left-hand axis forming with each of the left-hand struts an acute angle about equal to $j\times20.9°+k\times31.7°+m\times36°+n\times37.4°$, where j, k, m, and n are each an integer $\geqq0$; and several right-hand nodes each bearing against a respective one of said right-hand struts' distal portions such that a right-hand axis parallel to the baseplane passes through each of the right-hand nodes, the right-hand axis forming with each of the right-hand struts an acute angle about equal to $p\times20.9°+q\times31.7°+r\times36°+s\times37.4°$, where p, q, r, and s are each an integer $\geqq0$.

2. The node-and-strut structure of claim 1 in which said primary, left-hand and right-hand nodes each primarily comprise an iron-containing alloy.

3. The node-and-strut structure of claim 1 in which said primary, left-hand and right-hand nodes each include at least 1% metal by weight.

4. The node-and-strut structure of claim 1 in which said struts each include at least 1% carbon fiber by weight.

5. The node-and-strut structure of claim 1 in which all of said acute angles that are formed with the left-hand axis are within 0.4° of $j\times20.9°+k\times31.7°+m\times36°+n\times37.4°$.

6. The node-and-strut structure of claim 1 in which said left-hand and right-hand nodes each have a metallic surface bearing against a respective one of said distal portions.

7. The node-and-strut structure of claim 1 in which the left-hand and right-hand struts of each of the vertebrae form a primary angle there between that is nominally equal to an acute angle of $b\times20.9°+d\times31.7°+e\times35.3°+f\times36°$, where b, d, e, and f are each an integer $\geqq0$.

8. The node-and-strut structure of claim 1 in which the left-hand and right-hand struts of each of the vertebrae form a primary angle therebetween that is nominally complementary to an acute angle of $b\times20.9°+d\times31.7°+e\times35.3°+f\times36°$, where b, d, e, and f are each an integer $\geqq0$.

9. The node-and-strut structure of claim 1 in which the left-hand and right-hand struts of each of the vertebrae form a primary angle therebetween that is nominally complementary to an acute angle of $b\times20.9°+d\times31.7°+e\times35.3°+f\times36°$, where b is a positive integer and d, e, and f are each an integer $\geqq0$.

10. The node-and strut structure of claim 1 in which the left-hand and right-hand struts of each of the vertebrae form a primary angle therebetween that is nominally complementary to an acute angle of $b\times20.9°+d\times31.7°+e\times35.3°+f\times36°$, where d is a positive integer and b, e, and f are each an integer $\geqq0$.

11. The node-and-strut structure of claim 1 in which the left-hand and right-hand struts of each of the vertebrae form a primary angle therebetween that is nominally complementary to an acute angle of $b\times20.9°+c\times30°+d\times31.7°+e\times35.3°+f\times36°+g\times37.4°$, where b, c, d, e, f, and g are each an integer $\geqq0$.

12. The node-and-strut structure of claim 1 in which the set of vertebrae are nominally regularly spaced.

13. The node-and-strut structure of claim 1 in which $j>0$.

14. The node-and-strut structure of claim 1 in which $k>0$.

15. The node-and-strut structure of claim 1 in which $j=p=0$.

16. The node-and-strut structure of claim 1 in which $k=q=0$.

17. The node-and-strut structure of claim 1 in which $m=r=0$.

18. The node-and-strut structure of claim 1, further comprising several additional strut ends each bearing against a corresponding one of the left-hand nodes.

19. The node-and-strut structure of claim 18 in which the number of said additional strut ends is exactly T, where T is at least 4.

20. The node-and-strut structure of claim 1 in which the set of vertebrae includes at least eight vertebrae.

21. The node-and-strut structure of claim 1, further including several inter-primary struts each coupled to a corresponding pair of the primary nodes.

22. The node-and-strut structure of claim 1, in which said primary, left-hand and right-hand nodes and several additional nodes are all positioned exteriorly so as to form an oblong shape substantially resembling a tube having a polygonal cross section, further comprising several other, interiorly-positioned nodes.

23. A method of making a node-and-strut structure comprising steps of:

(a) assembling a set of at least six vertebrae each including one left-hand strut having a proximal portion and a distal portion, one right-hand strut having a proximal portion and a distal portion, and one primary node rigidly engaging the left-hand strut's proximal portion and the right-hand strut's proximal portion, a primary axis passing through each of the primary nodes, the primary nodes each including at least 1% metal by weight, the left-hand struts all being nominally mutually parallel, the right-hand struts all being nominally mutually parallel also;

(b) bringing several left-hand nodes each to bear against a respective one of said left-hand struts' distal portions such that a left-hand axis lying in a baseplane with the primary axis passes through each of the left-hand nodes, the left-hand axis forming with each of the left-hand struts an acute angle about equal to $j\times20.9°+k\times31.7°+m\times36°+n\times37.4°$, where j, k, m, and n are each an integer $\geqq0$; and (c) bringing several right-hand nodes each to bear against a respective one of said right-hand struts' distal portions such that a right-hand axis parallel to the baseplane passes through each of the right-hand nodes, the right-hand axis forming with each of the right-hand struts an acute angle about equal to $p\times20.9°+q\times31.7°+r\times36°+s\times37.4°$, where p, q, r and s are each an integer $\geqq0$.

24. The method of claim 23, further including wherein at least three struts are not nominally mutually coplanar and further including a triangulation step (d) of adding to said node-and-strut structure several additional nodes and several additional struts so that all of the nodes each bear against at least three of the struts that are not nominally mutually coplanar.

25. The method of claim 24 in which said struts each have an actual length that is nominally included in a predefined length set consisting of 6 lengths.

* * * * *